US009651322B2

(12) United States Patent
Tirkschleit et al.

(10) Patent No.: US 9,651,322 B2
(45) Date of Patent: May 16, 2017

(54) CLEANING DEVICE FOR A COMBUSTION BOILER

(75) Inventors: Marc Tirkschleit, Wesel (DE); Ricardo Cabrera, Dinslaken (DE)

(73) Assignee: Clyde Bergermann GmbH Maschinen-Und Apparatebau, Wesel (DE)

( * ) Notice: Subject to any disclaimer, the term of this patent is extended or adjusted under 35 U.S.C. 154(b) by 482 days.

(21) Appl. No.: 13/885,288

(22) PCT Filed: Oct. 21, 2011

(86) PCT No.: PCT/EP2011/068387

§ 371 (c)(1),
(2), (4) Date: Aug. 2, 2013

(87) PCT Pub. No.: WO2012/065803

PCT Pub. Date: May 24, 2012

(65) Prior Publication Data

US 2013/0312672 A1 Nov. 28, 2013

(30) Foreign Application Priority Data

Nov. 17, 2010 (DE) ..... 10 2010 051 657

(51) Int. Cl.
*F28G 15/04* (2006.01)
*F28G 3/16* (2006.01)

(52) U.S. Cl.
CPC ..... *F28G 15/04* (2013.01); *F28G 3/163* (2013.01)

(58) Field of Classification Search
CPC ..... B65H 75/4439; B65H 75/4405; B65H 75/4471; B65H 75/364; B08B 9/045; B08B 9/0492; F28G 15/04; F28G 15/06; F28G 15/08; F16L 1/203; B63G 2008/007
USPC ..... 242/364.11, 366.2, 361.4, 361.5, 364.3, 242/386, 362, 361
See application file for complete search history.

(56) References Cited

U.S. PATENT DOCUMENTS 2,282,600 A * 5/1942 Blanc ..... E03F 9/002 15/104.33
2,595,655 A * 5/1952 Hannay ..... B65H 75/38 137/355.2
3,007,186 A * 11/1961 Olsson ..... E03F 9/005 15/104.33
3,370,599 A 2/1968 Ciaccio
3,928,885 A * 12/1975 Peterson et al. ..... 15/104.33
4,773,113 A 9/1988 Russell
5,184,636 A * 2/1993 van der Woude ..... 134/167 C
(Continued)

FOREIGN PATENT DOCUMENTS

CN 1890527 A 1/2007
DE 20122403 U1 12/2005
(Continued)

*Primary Examiner* — Steven B McAllister
*Assistant Examiner* — Steven Anderson, II
(74) *Attorney, Agent, or Firm* — Bainwood Huang

(57) ABSTRACT

A cleaning device for a combustion boiler, comprising a high-temperature-resistant cleaning hose for feeding a cleaning medium into the combustion boiler, a hose reel which can be rotated about a first axis of rotation, wherein the cleaning hose can be wound at least partially in said reel, and wherein the hose reel comprises an opening through which the cleaning hose can be guided during winding or unwinding parallel to the first axis of rotation.

16 Claims, 4 Drawing Sheets

(56) References Cited

U.S. PATENT DOCUMENTS

Figure 1:
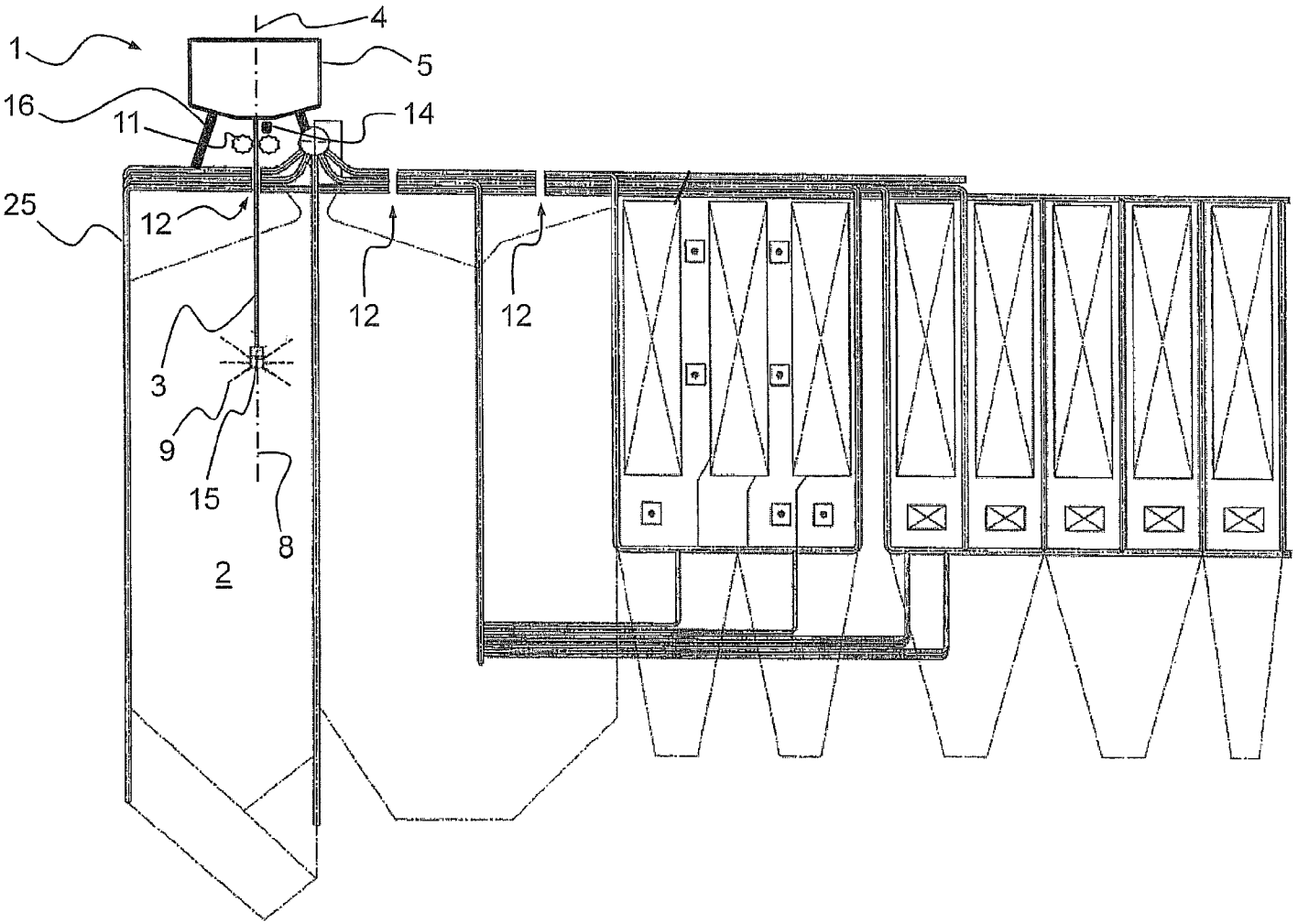

| | | | | |
|---|---|---|---|---|
| 5,615,734 | A * | 4/1997 | Hyp | 165/11.2 |
| 6,276,625 | B1 * | 8/2001 | Chee | G06Q 40/04 114/312 |
| 2004/0069331 | A1 * | 4/2004 | Garman et al. | 134/167 C |
| 2006/0260652 | A1 * | 11/2006 | Kruse | 134/22.1 |
| 2010/0071734 | A1 | 3/2010 | Kim et al. | |
| 2011/0006146 | A1 * | 1/2011 | Soper et al. | 242/373 |
| 2012/0025002 | A1 * | 2/2012 | Zink | 242/390.2 |

FOREIGN PATENT DOCUMENTS

| | | | |
|---|---|---|---|
| EP | 0526120 | A1 | 2/1993 |
| EP | 1291598 | | 12/2003 |
| JP | 5343214 | | 4/1978 |
| JP | 57180572 | | 11/1982 |
| JP | 6026883 | | 2/1985 |
| JP | 2007513312 | | 5/2007 |
| WO | 2005032725 | A2 | 4/2005 |
| WO | 2005054770 | A1 | 6/2005 |

* cited by examiner

CLEANING DEVICE FOR A COMBUSTION BOILER

The present invention relates to a cleaning device for cleaning surfaces, in particular heat exchange surfaces, of a combustion boiler. The invention is used in particular with combustion boilers of fossil-fired power stations, incineration plants and/or power stations operated with biomass.

With known cleaning devices for combustion boilers, flexible cleaning hoses are also used, which, to clean a combustion boiler, are passed generally perpendicularly into the combustion boiler through apertures in a wall of the combustion boiler. To this end, outside the combustion boiler and in the region of a respective aperture in a wall of the combustion boiler, the cleaning hose is generally wound on a hose reel, with the aid of which the cleaning hose for cleaning can be passed down into the combustion boiler and then can be removed again. The cleaning hose is removed substantially completely from the combustion boiler between individual cleaning cycles and is wound on the hose reel. A device of this type is disclosed for example in EP-B1-1256761.

To clean surfaces, such as heat exchange surfaces in particular, the end of the cleaning hose that is passed down into the combustion boiler generally comprises a nozzle head comprising at least one nozzle, in particular comprising a baffle-nozzle. A cleaning medium is sprayed via the nozzles of the nozzle head onto the surfaces to be cleaned of the combustion boiler so as to then remove, at least in part, adhering contaminations or combustion residues, such as ash and/or slag. In this case, a gentle but at the same time thorough cleaning is desired in order to at least partly remove in particular insulating slag formations on heat exchange surfaces, without damaging the heat exchange surfaces in doing so.

It is also known that particularly intensive and gentle cleaning of the surfaces of a combustion boiler can be achieved by means of a rotating nozzle head. To this end, the nozzle head is mounted rotatably on one end of the cleaning hose and comprises a drive, with the aid of which the nozzle head can be rotated. In order to rotate the nozzle head at the end of a cleaning hose in the combustion boiler, a complex guidance of the flow of cleaning medium within the nozzle head is generally necessary. For example, rotors are thus arranged within the nozzle heads and are used to rotate the nozzle head through the cleaning medium flowing through. Such a nozzle head is known for example from DE-U-20122403. The cleaning heads, which can be driven in rotation, of known cleaning devices are therefore characterized by a complex and maintenance-intensive structure.

The object of the invention is therefore to solve, at least in part, the technical problems described with reference to the prior art and in particular to specify a cleaning device for a combustion boiler, with which a nozzle head at the end of a cleaning hose can be driven particularly easily and cost-effectively within the combustion boiler.

These objects are achieved with a cleaning device for a combustion boiler, including a high-temperature-resistant cleaning hose for feeding a cleaning medium into the combustion boiler, and a hose reel rotatable about a first axis of rotation and in which the cleaning hose can be wound at least in part, where the hose reel comprises an opening, through which the cleaning hose can be guided during winding or unwinding parallel to the first axis of rotation. Further advantageous embodiments of the cleaning device may be found in the description. It is noted that the features described can be combined with one another in any technically feasible manner and can define further embodiments of the invention. In addition, the features disclosed will be explained in greater detail in the description, wherein further preferred embodiments of the invention will be presented.

The cleaning device according to the invention for a combustion boiler comprises a high-temperature-resistant cleaning hose for feeding a cleaning medium into the combustion boiler, and a hose reel, which is rotatable about a first axis of rotation and in which the cleaning hose can be wound at least in part, wherein the hose reel comprises an opening, through which the cleaning hose can be guided during winding or unwinding parallel to the first axis of rotation.

The cleaning device according to the invention comprises a flexible high-temperature-resistant cleaning hose, which has a temperature resistance with regard to an ambient temperature up to 800° C., preferably up to 1,000° C., particularly preferably up to 1,400° C., or even thereabove. To this end, the cleaning hose may comprise in particular a metal and/or ceramic covering, for example formed from a metal braid and/or a ceramic coating. A cleaning medium, for example water (possibly with an additive) and/or water vapor, is guided via this cleaning hose from a store of the cleaning medium into a combustion boiler. To this end, the cleaning hose comprises at one end a nozzle head with preferably one baffle-nozzle or a plurality of nozzles, via which the cleaning medium can be sprayed onto surfaces to be cleaned of the combustion boiler. The cleaning hose and/or the nozzle head may comprise at least one, in particular mechanical, cleaning implement, for example brushes, for cleaning apertures in a wall of a combustion boiler. The cleaning hose and/or the hose reel and/or the (entire) cleaning device is/are preferably substantially (highly) corrosion-resistant.

The cleaning device further comprises a hose reel, which is rotatable about a first axis of rotation and in which the cleaning hose, and here in particular the end of the cleaning hose opposite the nozzle head, can be wound. The first axis of rotation is oriented substantially perpendicularly with respect to a (in particular horizontally arranged) winding plane of the hose reel. The cleaning device can additionally be attached via a stand to a wall of the combustion boiler. The stand may additionally be movable and/or displaceable so that various apertures for the cleaning hose, which are fitted on a wall of the combustion boiler, can be reached by the cleaning device and therefore a plurality of regions of a combustion boiler can be cleaned by a number of cleaning devices in a particularly simple manner, the number of cleaning devices being lower than a number of apertures for cleaning hoses in the walls of the combustion boiler.

The hose reel comprises an (inwardly arranged) hose chamber, which is preferably rotationally symmetrical, for example cylindrical. The hose chamber is defined substantially by (outer) side walls of the hose reel, which preferably consist of metal and may possibly comprise cooling openings for the cleaning hose. In this case, the hose chamber itself preferably forms a type of outer cassette, receptacle, housing or the like for the cleaning hose, such that the cleaning hose is protected in particular against dirt from the surrounding environment and/or against damage during transport. The cleaning hose can be wound at least in part within the hose chamber of the hose reel (in a spiraled manner on outer walls of the hose chamber) and fastens the end of the cleaning hose opposite the nozzle head in the hose chamber at least in part, for example at a feed point for the cleaning medium. The hose reel additionally comprises an opening for the cleaning hose, which connects the hose chamber to the surrounding environment. Here, the cross section of the opening is at least as large as the cross section of the cleaning hose, such that the cleaning hose can be guided through the opening parallel and preferably concentrically with the first axis of rotation during winding and/or unwinding. To this end, the cleaning device may comprise a drive for the cleaning hose, through which the cleaning hose can be guided into or out from the hose chamber of the hose reel. In addition, the hose reel can also be driven in rotation via a first motor about the first axis of rotation, such that the cleaning hose within the hose chamber of the hose reel and/or a part of the cleaning hose guided out from the hose chamber via the opening in the hose reel can be rotated parallel to the first axis of rotation. By means of the cleaning hose driven rotatably in such a way, the nozzle head can in turn be driven in rotation in a particularly simple manner, such that separate drive devices are not required for a rotational movement.

In accordance with a further embodiment, the cleaning device comprises a hose guide with a second axis of rotation parallel to the first axis of rotation of the hose reel, wherein the hose guide is rotatable with the hose reel or relative to the hose reel about the second axis of rotation. In particular, the first axis of rotation and the second axis of rotation may be coincident, that is to say they may overlap one another in particular.

In particular, the hose guide is a (substantially L-shaped and/or metal) pipe, which can extend at least in part through the opening in the hose reel into the hose chamber. Here, the hose guide extends in particular outside the hose chamber substantially parallel to the first axis of rotation and/or within the hose chamber at least partly at an angle to the first axis of rotation. The angle in particular is approximately 30°, preferably approximately 60° or particularly preferably approximately 90°. The hose guide is mounted rotatably about the second axis of rotation.

In its interior, the hose guide leads the cleaning hose from the surrounding environment through the opening in the hose reel into the cleaning chamber and deflects the cleaning hose in the hose chamber in the direction of the outer walls of the hose chamber. To this end, the hose guide extends in particular through the opening into the hose chamber of the hose reel. The hose guide can be driven via a second motor about the second axis of rotation, either with the hose reel or relative to the hose reel. In particular, this means that the hose guide (selectively or as required) can be driven at a lower, the same, and/or a higher angular velocity compared to the hose reel in a clockwise or anti-clockwise direction.

If the hose reel is driven at a higher angular velocity than the hose guide in a winding direction of the cleaning hose, the cleaning hose is thus drawn into the hose chamber of the hose reel. If the hose reel is driven at a lower angular velocity than the hose guide in the winding direction of the cleaning hose, the cleaning hose is thus guided out from the hose chamber of the hose reel. If the angular velocity in the winding direction or unwinding direction of the hose reel is identical to the angular velocity of the hose guide, the cleaning hose is neither guided from nor guided into the hose chamber of the hose reel, but is merely driven in rotation. A winding direction of the cleaning hose is understood here to mean the direction of rotation of the hose reel and/or hose guide in which the hose reel has to be rotated when the hose guide is stationary in order to wind the cleaning hose in the hose chamber. An unwinding direction of the cleaning hose is understood here to mean the direction of rotation of the hose reel and/or hose guide, in which the hose reel has to be rotated when the hose guide is stationary in order to guide the cleaning hose out from the hose chamber. The winding direction and the unwinding direction run in opposite directions in principle and correspond selectively either to a clockwise direction or an anti-clockwise direction depending on the winding direction of the cleaning hose within the hose chamber.

The cleaning hose and therefore also the nozzle head can therefore be driven in rotation within the combustion boiler as a result of the rotation of the hose reel about the first axis of rotation and the rotation of the hose guide about the second axis of rotation, without the need for a separate drive for the nozzle head. In addition, the hose guide makes it possible for the nozzle head to be easily passed down, drawn up and/or held at a height of the combustion boiler without having to stop a rotation of the nozzle head in doing so.

The hose reel preferably has a conical inner cross section. As a result of such an embodiment, the cleaning hose can be wound particularly advantageously within the hose chamber.

In a development of the invention, it is proposed for the hose reel comprising the cleaning hose to be exchangeable. This means in particular that the hose reel comprising the cleaning hose can be detached from the rest of the cleaning device and can be replaced in a simple manner by another hose reel comprising another cleaning hose. As a result, the hose reel and the cleaning hose can be disassembled for maintenance purposes and/or the cleaning hose can be replaced by another cleaning hose, for example comprising another nozzle head, without having to interrupt the readiness for use of the cleaning device over a long period of time. The cleaning device may thus be connected to an adapter and/or quick-action closure comprising the hose reel, such that the removal or attachment of the hose reel can be undertaken effortlessly, for example by one person. The hose reel in particular may comprise support belts or a support stand for this purpose, such that the hose reel comprising the cleaning hose can be transported by one or more individuals without further aids.

It is likewise advantageous if the cleaning device comprises a drive for moving the cleaning hose along the first axis of rotation. Particularly reliable winding and/or (in particular) unwinding of the cleaning hose in the hose chamber of the hose reel is thus ensured. Here, it is preferred if the hose guide and the hose reel can be driven independently of one another, for example as a result of the provision of respective drives, of which the operation can be controlled in accordance with the desired movement of the nozzle head.

It is further advantageous if the cleaning device comprises at least one cleaning unit for the cleaning hose or at least one monitoring unit for determining a position of the cleaning hose. By means of such a cleaning unit, the cleaning hose can be freed from adhesions, for example soot or slag, for example after a (predefined) cleaning cycle, before it is drawn into the hose chamber of the hose reel. To this end, the cleaning unit may comprise mechanical cleaning means for example, such as brushes or spraying devices for compressed air and/or cleaning fluids. Contaminations of the hose chamber can thus be avoided. Such a cleaning unit is preferably provided in the region of the opening in the hose reel and/or the hose guide.

In particular, the length of the part of the cleaning hose guided out from the hose reel and/or the position or the spatial position or height of the nozzle head in the combustion boiler can be determined by means of the monitoring unit, which may be provided alternatively or in combination with the cleaning unit.

The cleaning device most preferably comprises at least one hose guide wheel, which is arranged at least in part in the hose reel and guides the cleaning hose.

The hose guide wheel in particular is round (circular) and consists substantially of metal, plastic, rubber or wood or of a combination of these materials. In particular, an outer circumference of the hose guide wheel can be formed at least in part from wood. A supporting face or guide face made of wood has the advantage that a drive without slip can be ensured in a lasting manner, even in combination with a wet, metal cleaning hose. In addition, the hose guide wheel is arranged in a space-saving manner in the hose reel, at least in part, and is mounted rotatably about a third axis of rotation. The hose guide wheel guides the cleaning hose (at least in part) to an inner circumferential face of the hose reel, wherein this preferably occurs between the opening and the inner circumferential face of the hose reel. The inner circumferential face of the hose reel is the face of the hose reel against which the cleaning hose bears when wound in the hose chamber of the hose reel. The cleaning hose can be wound in the hose reel and unwound again in a particularly reliable manner as a result of the hose guide wheel.

To this end, the cleaning hose is guided at least in part on an outer circumference of the hose guide wheel. In this case, the cleaning hose winds around the outer circumference of the hose guide wheel through at least 90°, preferably at least 150° or particularly preferably through at least 180°. It can thus be ensured that the static friction between the outer circumference of the hose guide wheel and the cleaning hose is sufficiently large so that the cleaning hose can be guided by the hose guide wheel substantially without slip.

It is also advantageous if the hose guide wheel can be driven by a third motor or if the position of the hose guide wheel can be adjusted parallel to the first axis of rotation of the hose reel. Both aforementioned means are particularly preferably provided.

In particular, this means that the hose guide wheel is rotatable in a clockwise direction or an anti-clockwise direction by the third motor about a third axis of rotation, which is preferably located in the center of the hose guide wheel. The cleaning hose can thus be driven by the hose guide wheel and can therefore be drawn into or guided out from the hose reel.

The adjustability of the position of the hose guide wheel parallel to the first axis of rotation means that the cleaning hose can be wound and unwound at the inner circumferential face of the hose reel at any points parallel to the first axis of rotation. It is thus also possible for the hose guide wheel to protrude (in part) from the hose reel in specific operating conditions, in particular to protrude upwardly in the uppermost position when the cleaning hose is wound fully.

It is likewise advantageous if the hose guide wheel is mounted rotatably within the hose reel eccentrically about the first axis of rotation. In other words, the first axis of rotation does not run through the center of rotation of the hose guide wheel, but is distanced therefrom. This is proposed in order to generate an improved contact pressure between the cleaning hose and the hose guide wheel, such that the cleaning hose can be guided substantially without slip on the outer circumference. A particularly space-saving arrangement can thus also be achieved.

The cleaning hose preferably comprises three bends between the opening and an inner circumferential face of the hose reel. In particular, this means that the cleaning hose bears against the inner circumferential face with a predefined (horizontally oriented) radius of bend. For example with use of guide rollers and/or the hose guide wheel, this bend of radius is altered multiple times in terms of the value and/or the orientation in order to guide the hose in an inner region of the hose reel out from the horizontal plane (upwardly), around the first axis of rotation and lastly (substantially) perpendicularly downwardly. This is preferably achieved with (precisely) three different bends in a particularly space-saving and gentle manner for the cleaning hose. It should be clarified that the cleaning hose may also have more than three bends between the opening and the inner circumferential face of the hose reel, wherein at least three bends of the cleaning hose are sufficient in order to ensure a particularly process-reliable guidance of the cleaning hose within the hose reel.

In accordance with a further aspect of the invention, a combustion boiler is also proposed, which comprises at least one feed through for a cleaning hose and a cleaning device according to the invention. So as to be able to introduce the cleaning hose of the cleaning device into the combustion boiler, the at least one feed through is introduced into walls of the combustion boiler. In addition, the cleaning device is fastened to the combustion boiler, in particular by means of a stand. In this case, the cleaning device can be fastened both in a stationary manner and also movably on the cleaning device, for example via rails, so that a cleaning device can be fed through in different ways into the combustion boiler. Different regions of a combustion boiler can thus advantageously be reached by the cleaning device. For the rest, reference is made to the description of the cleaning device in connection with the combustion boiler according to the invention, and vice versa.

Figure 2:
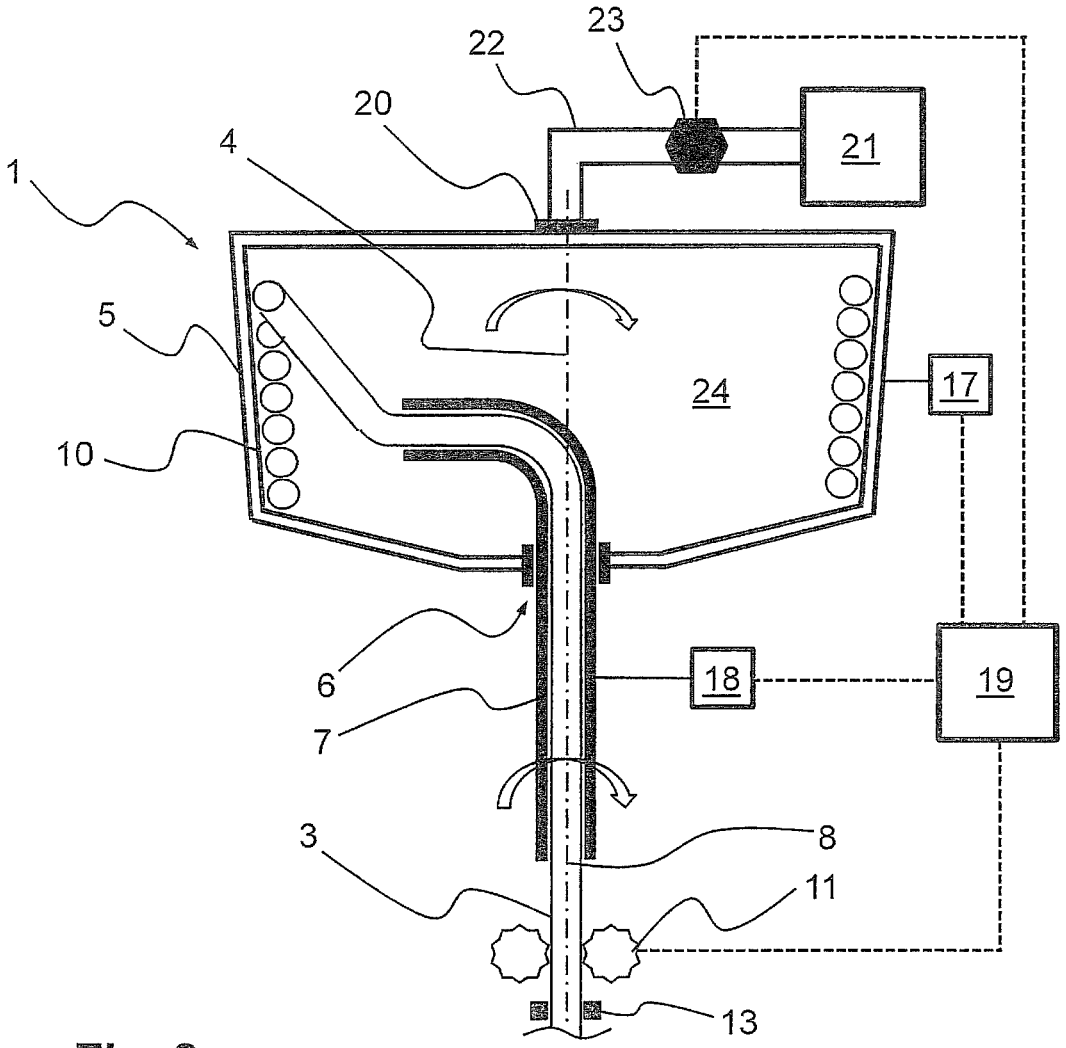
Figure 3:
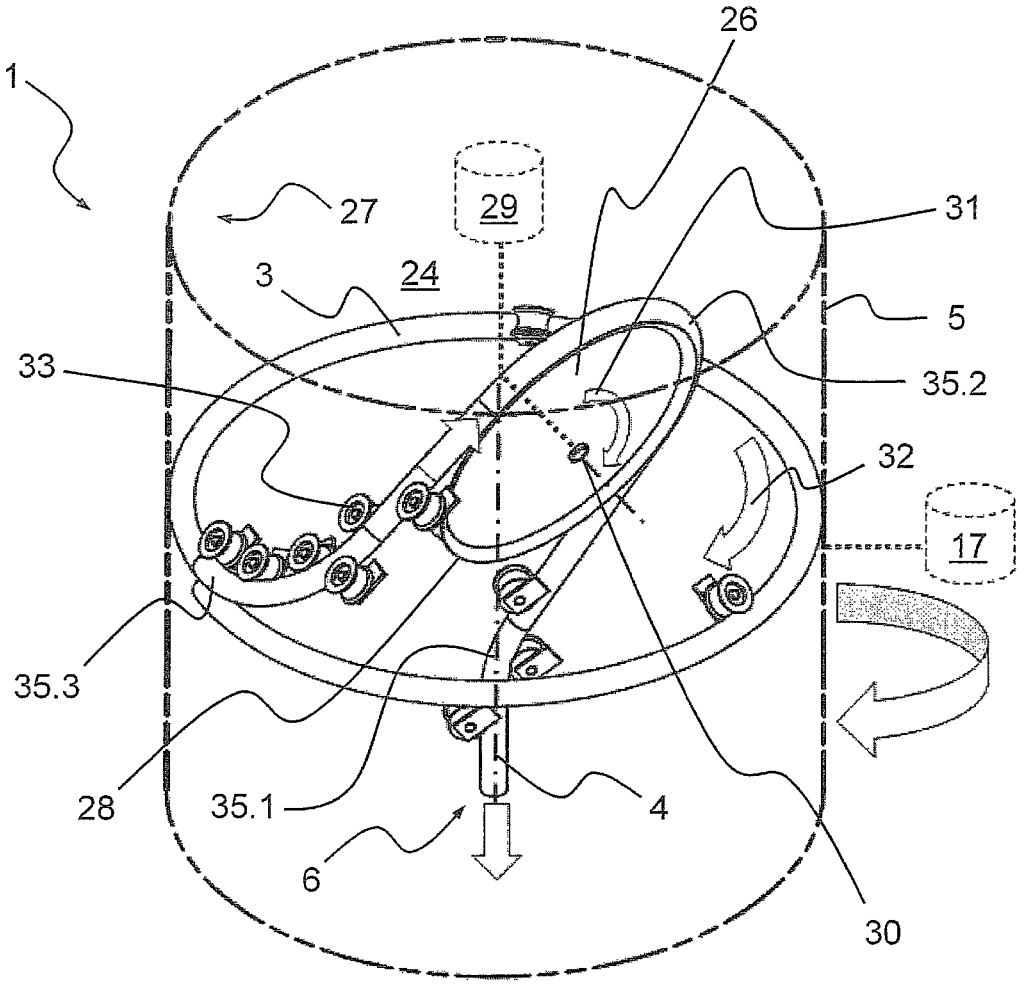
Figure 4:
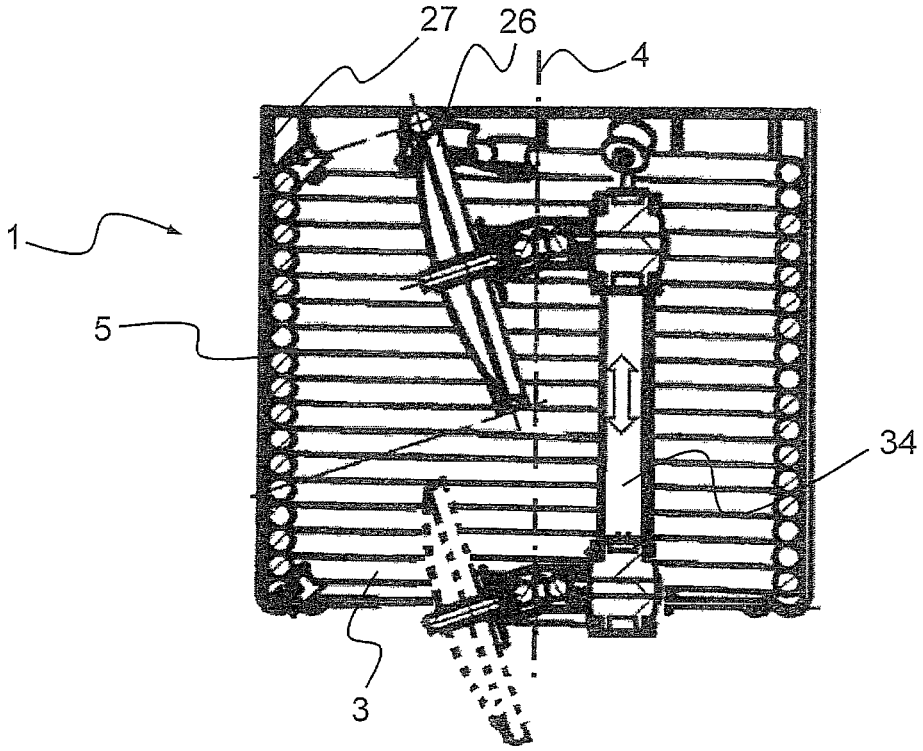

The invention and the technical scope will be explained in greater detail hereinafter with reference to the figures. It is noted that the figures show particularly preferred variants of the invention, but are not limited thereto. In the drawings:

FIG. 1: shows a schematic view of a combustion boiler with a cleaning device according to the invention, FIG. 2: shows a schematic view of a longitudinal section through the cleaning device according to the invention, FIG. 3: shows a schematic view of a further embodiment of a cleaning device according to the invention with an unwound cleaning hose, and FIG. 4: shows a schematic view of a further embodiment of a cleaning device according to the invention with a wound cleaning hose.

FIG. 1 shows a combustion boiler 2 with a cleaning device 1. The cleaning device 1 is fastened on the combustion boiler 2 via a stand 16 at a wall 25 of the combustion boiler. The cleaning device 1 comprises a hose reel 5, which is mounted rotatably about a first axis of rotation 4 and in which a cleaning hose 3 can be wound at least in part. In the present example embodiment, the cleaning hose 3 is guided into the combustion boiler 2 via one of the feedthroughs 12 of the combustion boiler 2, such that a cleaning medium 9 can be sprayed via a nozzle head 15 of the cleaning hose 3 in the direction of surfaces to be cleaned of the combustion boiler 2. In order to pass the cleaning hose 3 down into the combustion boiler 2, the cleaning device 1 comprises a drive 11 for the cleaning hose 3. In addition, a monitoring unit 14 is arranged in the region of the feedthrough 12 in order to monitor the position of the cleaning hose 3 and therefore of the nozzle head 15 within the combustion boiler 2.

FIG. 2 shows a longitudinal section through a cleaning device 1 comprising a hose reel 5, in which a hose chamber 24 for the cleaning hose 3 is formed. In this example embodiment, the hose chamber 24 has a conical inner cross section 10. The hose reel 5 can additionally be driven via a first axis of rotation 4 with the aid of a first motor 17. The hose reel 5 further comprises an opening 6, via which the hose chamber 24 is connected to the surrounding environment. A hose guide 7, which is rotatable about a second axis of rotation 8, which runs coaxially with the first axis of rotation 4, extends through the opening 6. The hose guide 7 is additionally mounted rotatably in the opening 6 and can be driven by a second motor 18 independently of the hose reel 5. In the present embodiment, the cleaning hose 3 can be guided into or out from the hose chamber 24 by means of the hose guide 7, when this is driven at an angular velocity deviating from the hose reel, and/or by means of the drive 11. The cleaning device 1 additionally comprises a cleaning unit 13, which is formed here as a pneumatic blow-off nozzle. In particular, adhesions of ash, soot or slag from the combustion boiler 2 (not shown here; see FIG. 1) can be cleaned off by means of this cleaning unit 13 before the cleaning hose 3 is drawn into the hose chamber 24. To this end, the cleaning unit 13 is arranged in particular beneath the drive 11. The cleaning hose 3 is additionally connected via a rotational coupling 20 and a feed point 22 to a store 21 for a cleaning medium 9 (not shown here). In addition, the feed point 22 is coupled to a pump 23, such that the cleaning medium 9 (not shown here) can be conveyed from the store 21 to the nozzle head 15 (likewise not shown here) at the opposite end of the cleaning hose 3. In addition, the drive 11 for the cleaning hose 3, the first motor 17 for the hose reel 5, the second motor 18 for the hose guide 7, and the pump 23 are connected to a control unit 19 in a data-conducting manner. The control unit 19 is designed to apply the cleaning medium 9 (not shown here) to dirty surfaces of the combustion boiler 2 as necessary and/or to drive the nozzle head (not shown here), including the cleaning hose 3, in rotation.

FIG. 3 shows a further example embodiment of a cleaning device 1 according to the invention comprising a hose guide wheel 26, wherein features of the previous example embodiment can be combined in a technically feasible manner with the example embodiment according to FIG. 3 and vice versa. The hose guide wheel 26 comprises an outer circumference 28, on which the cleaning hose 3 can be guided into and out from the hose chamber 24 through the opening 6, wherein the cleaning hose 3 is wound inside the hose chamber 24, in particular in a spiraled manner, at an inner circumferential face 27 of the hose reel 5. To this end, the hose guide wheel 26 can be driven by a third motor 29 about a third axis of rotation 30 in a first direction of rotation 31 or against the first direction of rotation 31, wherein the third axis of rotation 30 is inclined with respect to the first axis of rotation 4 by an angle. The connection between the third motor 29 and the hose guide wheel 26 may also comprise in particular at least one joint and/or at least one gear. If the hose guide wheel 26 is driven in the first direction of rotation 31, the cleaning hose 3 is guided out from the hose chamber 24 through the opening 6. The hose guide wheel 26 thus additionally rotates about the first axis of rotation 4 in a second direction 32 or against the second direction of rotation 32 when the cleaning hose 3 is guided in. It can also be seen that the cleaning hose 3 is guided via three bends 35.1, 35.2, 35.3 between the opening 6 and the inner circumferential face of the hose reel 5. To this end, additional guide rollers 33 may be arranged within the hose chamber 24, in particular so as to also increase a contact pressure between the cleaning hose 3 and the outer circumference of the hose guide wheel 26. The hose reel 5 can additionally be driven about the first axis of rotation 4 with the aid of the first motor 17. Such a rotation (indicated by the outer large arrow; optionally also in the opposite direction) can be used to rotate the cleaning hose 3 and therefore also the nozzle head 15, even if there is no unwinding of the cleaning hose 3, that is to say the nozzle head 15 resides at a height in the combustion boiler 2 (or in a downstream region).

FIG. 4 shows the mounting of the hose guide wheel 26 of a cleaning device 1 in accordance with the example embodiment shown in FIG. 3. In FIG. 4, the cleaning hose 3 is wound substantially completely in the hose reel 5. Due to the spiraled winding of the cleaning hose 3, there is an adjustment of the position of the hose guide wheel 26 along the first axis of rotation 4. To this end, the hose guide wheel 26 is fastened (vertically) adjustably on a support 34. In the lower region of FIG. 4, the hose guide wheel 26 (dashed) including joint and gear is shown in a vertically adjusted (lower) position, in which the cleaning hose 3 is substantially unwound. The support 34 is in turn pivotable with the hose guide wheel 26 about the first axis of rotation 4 and is accordingly mounted in the upper region on the hose reel 5 and/or outside the hose reel 5.

The present invention is characterized by a particularly simple and cost-effective rotary drive of the nozzle head of the cleaning device.

LIST OF REFERENCE SIGNS

1 cleaning device
2 combustion boiler
3 cleaning hose
4 first axis of rotation
5 hose reel
6 opening
7 hose guide
8 second axis of rotation
9 cleaning medium
10 inner cross section
11 drive
12 feedthrough
13 cleaning unit
14 monitoring unit
15 nozzle head
16 frame
17 first motor
18 second motor
19 control unit
20 rotary coupling
21 store
22 feed
23 pump
24 hose chamber
25 wall
26 hose guide wheel
27 inner circumferential face
28 outer circumference
29 third motor
30 third axis of rotation
31 first direction of rotation
32 second direction of rotation
33 guide roller
34 support
35.1, 35.2, 35.3 bend

The invention claimed is:

1. A cleaning device for a combustion boiler, comprising:

a high-temperature-resistant cleaning hose for feeding a cleaning medium into the combustion boiler, a hose reel, which is rotatable about a first axis of rotation and in which a hose chamber is arranged, wherein the cleaning hose can be wound at least in part in the hose chamber on an inner circumferential face of the hose reel, wherein the hose reel comprises an opening, through which the cleaning hose can be guided during winding or unwinding parallel to the first axis of rotation, and at least one hose guide wheel, which is arranged at least in part in the hose chamber of the hose reel and guides the cleaning hose to the inner circumferential face of the hose reel, wherein the at least one hose guide wheel can be driven by a motor, wherein the cleaning hose is wound around the hose guide wheel for a length that comprises an angle of at least 90° of an outer circumference of the hose guide wheel, wherein the position of the hose guide wheel can be adjusted parallel to the first axis of rotation of the hose reel, wherein the hose guide wheel is movable parallel to the first axis of rotation of the hose reel relative to the hose reel and wherein the hose guide wheel is mounted rotatably within the hose reel eccentrically about the first axis of rotation.

2. The cleaning device as claimed in claim 1, wherein the hose reel with the cleaning hose is exchangeable.

3. The cleaning device as claimed in claim 1, comprising a drive for moving the cleaning hose along the first axis of rotation.

4. The cleaning device as claimed in claim 1, comprising at least one cleaning unit for the cleaning hose or at least one monitoring unit for determining a position of the cleaning hose.

5. The cleaning device as claimed in claim 1, wherein the cleaning hose comprises three bends between the opening and an inner circumferential face of the hose reel.

6. A combustion boiler, comprising:

a cleaning device; and at least one feedthrough for a cleaning hose of the cleaning device; wherein the cleaning device includes:

a high-temperature-resistant cleaning hose for feeding a cleaning medium into the combustion boiler, a hose reel, which is rotatable about a first axis of rotation and in which a hose chamber is arranged, wherein the cleaning hose can be wound at least in part in the hose chamber on an inner circumferential face of the hose reel, wherein the hose reel comprises an opening, through which the cleaning hose can be guided during winding or unwinding parallel to the first axis of rotation, and at least one hose guide wheel, which is arranged at least in part in the hose chamber of the hose reel and guides the cleaning hose to the inner circumferential face of the hose reel, wherein the at least one hose guide wheel can be driven by a motor, wherein the cleaning hose is wound around the hose guide wheel for a length that comprises an angle of at least 90° of an outer circumference of the hose guide wheel, wherein the position of the hose guide wheel can be adjusted parallel to the first axis of rotation of the hose reel, wherein the hose guide wheel is movable parallel to the first axis of rotation of the hose reel relative to the hose reel and wherein the hose guide wheel is mounted rotatably within the hose reel eccentrically about the first axis of rotation.

7. The cleaning device as claimed in claim 1, wherein the first axis of rotation is oriented vertical.

8. The cleaning device as claimed in claim 1, wherein a winding device of the hose reel is arranged horizontally.

9. The cleaning device as claimed in claim 1, wherein an outer circumference of the at least one hose guide is formed from wood.

10. The cleaning device as claimed in claim 1, wherein the hose guide wheel can be driven by the motor about an axis of rotation, which is located in a center of the hose guide wheel.

11. The cleaning device as claimed in claim 1, wherein a connection between the motor and the hose guide wheel includes at least one joint.

12. The cleaning device as claimed in claim 1, wherein guide rollers are arranged within the hose chamber in order to increase a contact pressure between the cleaning hose and the outer circumference of the hose guide wheel.

13. The cleaning device as claimed in claim 1, wherein the hose guide wheel is fastened vertically adjustably on a support.

14. The cleaning device as claimed in claim 1, wherein the at least one hose guide wheel and the hose reel are constructed and arranged to rotate simultaneously to selectively wind and unwind the cleaning hose.

15. The cleaning device as claimed in claim 1, further comprising:

another motor coupled to the hose reel, the other motor being constructed and arranged to drive the hose reel about the first axis to provide rotation, relative to surfaces within the combustion boiler, to the cleaning hose and to a nozzle head coupled to an end of the cleaning hose.

16. A cleaning device for a combustion boiler, comprising:

a high-temperature-resistant cleaning hose for feeding a cleaning medium into the combustion boiler, a hose reel that defines an inward facing hose bearing surface and an internal hose chamber, wherein the hose reel is constructed and arranged to rotate about a first axis of rotation while at least a portion of the cleaning hose bears against the inward facing hose bearing surface defined by the hose reel, a hose guide wheel, which is arranged at least in part within the hose chamber defined by the hose reel and which guides the cleaning hose toward the inward facing hose bearing surface defined by the hose reel, wherein the hose guide wheel is driven by a motor, wherein the cleaning hose winds around the hose guide wheel for a length that comprises an angle of at least 90° of an outer circumference of the hose guide wheel, wherein the position of the hose guide wheel is adjusted parallel to the first axis of rotation of the hose reel, wherein the hose guide wheel is movable parallel to the first axis of rotation of the hose reel relative to the hose reel, wherein the hose guide wheel is mounted rotatably within the hose reel eccentrically about the first axis of rotation, wherein the cleaning hose is directed at least in part within the hose chamber against the inward facing hose bearing surface defined by the hose reel by the hose guide wheel, and wherein the hose reel further defines an opening, through which the cleaning hose is guided during winding or unwinding parallel to the first axis of rotation.

* * * * *